United States Patent [19]

Martin

[11] 4,400,231

[45] Aug. 23, 1983

[54] TAPE DISPENSER/APPLICATOR

[75] Inventor: Andrew M. Martin, The Boston Core Group, 77 Gibbs St., Brookline, Mass. 02146

[73] Assignee: Andrew McG. Martin, Boston, Mass.

[21] Appl. No.: 220,273

[22] Filed: Dec. 29, 1980

[51] Int. Cl.[3] ..... B32B 31/04; B32B 35/00

[52] U.S. Cl. ..... 156/527; 156/577

[58] Field of Search ..... 156/527, 523, 574, 576, 156/577, 579

[56] References Cited

U.S. PATENT DOCUMENTS

| | | | |
|---|---|---|---|
| 2,722,331 | 11/1955 | Vogt | 156/527 |
| 3,586,587 | 6/1971 | Boyce | 156/527 |
| 3,645,831 | 2/1972 | Thaeler | 156/527 |
| 3,707,426 | 12/1972 | Robison | 156/527 |
| 3,843,439 | 10/1974 | Rohlwing | 156/523 |
| 3,895,059 | 7/1975 | Link | 156/527 |

*Primary Examiner*—Michael G. Wityshyn
*Attorney, Agent, or Firm*—Cesari and McKenna

[57] ABSTRACT

A one-piece, hand-held dispenser/applicator includes an element extending radially from a generally planar frame. A tape rest supports the lead end of the tape when the tape is not being used. A pressing surface and an adjoining cutting edge are also formed integrally with the element. At rest, the tip of the lead end of the tape extends in front of the pressing surface. In use, the operator applies the lead end of the tape to an object by pressing the pressing surface against the non-adhesive side of the tape. The operator then draws the dispenser-/applicator over the object while continually applying pressure to the pressure surface. When the exact amount of tape has been dispensed and applied, the contiguous cutting edge severs the tape by a simple wrist motion. The device permits direct, one-hand, accurate taping and eliminates inconveniences such as curling and wrinkling the tape.

4 Claims, 4 Drawing Figures

TAPE DISPENSER/APPLICATOR

BACKGROUND OF THE INVENTION

This invention pertains to the field of dispensing and applying tape that has an adhesive side, and specifically to one-piece, hand-held devices that both dispense and apply such tape.

A device that dispenses tape commonly does not also apply tape. That is, a dispenser is a device that houses a roll of tape and includes a cutting edge; an applicator further includes elements for applying the tape as it is dispensed. To apply tape from a dispenser, an individual must use two hands. One hand grasps the dispenser for stabilizing it; the other hand pulls an approximate length of tape from the roll. The tape then is twisted over a cutting edge to sever it from the roll. When the individual then has an approximate length of tape in one hand, he must attempt to apply the tape evenly and accurately while avoiding its tendency to curl or stick to itself. Simultaneously, the individual must steady the surface to be taped while simultaneously holding opposite ends of the tape. To minimize sticking the tape to fingers and ruining the tape's adhesiveness and transparency, the individual should avoid fingertip contact with the adhesive side at several locations.

These problems are widely experienced and point to the need for incorporating both dispensing and applying functions into a structure that accomplishes them quickly and easily and that can be used with one hand.

Although some combination dispenser/applicators exist in the prior art, these are distinct from my invention. Commonly, they are intended for applying a particular type of tape. One such device comprises a planar, triangular, open frame. A handle extends from one apex. A hub at a second apex supports a roll of tape. A pressing roller and cutting edge are located at the third apex. Tape is led from the roll through a closed, spring loaded gate between the handle and pressing roller and then past the roller. The tape is unsupported between the roller and the cutting edge, and the unsupported portion must be smoothed and applied by hand. Moreover, the rather substantial length of tape extending from the gate is free and leaves the adhesive side exposed.

Another device applies an "adhesive transfer" tape that retains a liner on the exposed surface of the tape as it is applied. After the tape has been applied, the liner can then be removed. In addition to a frame and a hub, this device includes a guide pin under which the lead end of the tape extends, and a cutting edge forward of the guide pin. No distinct area exists for pressing the tape to a surface as it is applied; instead, the cutting edge is angled to contact the tape as it is applied. Although this might be sufficient to engage the liner of a lined tape, the cutter's sharp edge limits the pressure that can be applied to a tape with a less substantial surface. Furthermore, the frame restricts the operator's view of the tape at its point of application, thereby limiting the precision with which a length of tape can be applied and cut.

Another device is designed primarily for dispensing and applying "L" and "C"-shaped sections of filament tape. This tape is used for binding or strapping, and the device includes specific elements for providing tension to the tape as it is drawn from the roll, including a braking system and buffing pads. After one buffing pad is used to press the first two inches of drawn tape to the object, the tape is wrapped around the object by using the braking system. The second buffing pad presses the last two inches of tape to the object. However, the device does not include a surface for applying direct and continued pressure to the tape.

Still another device uses banding or filament tape for bundling or strapping applications. It includes an element for holding the tape roll so the tape can be drawn tightly. But this device includes no element for pressing the tape as it is applied.

Another multi-piece device comprises a one-hand dispenser with a guide on the interior of the frame for directing the tape with its adhesive side downward to an opening. A pressing surface at the opening is adjacent a movable cutting edge. The cutting edge guides the tape through the opening to cut the tape, but only after the dispenser has been rotated counterclockwise approximately 90 degrees.

SUMMARY OF THE INVENTION

My object has been to produce a one-piece, hand-held dispenser/applicator that both dispenses and applies any of a variety of tapes with an adhesive side. The device is quick and easy to use, and evenly presses tape to surfaces. It reduces the possibility of wrinkling the tape, and aligns the tape accurately on its object. It also eliminates finger contact with the adhesive side with the consequent chance that the tape will curl or stick to itself. Tape can be accurately measured during application and precisely cut, still with one hand use. The tape also automatically positions for its next use.

These advantages are achieved by mounting a tape roll on a hub connected to a planar frame. A co-planar element extends substantially radially from the frame. A tape rest integral with the element and transverse to the plane of the frame supports the lead end of the tape. A curved pressing surface, also on the extending element and transverse to the plane of the frame, presses the lead end of the tape against an object. As the device is drawn over the area to be taped, the tape is dispensed, applied, and pressed accurately and easily. A cutting edge adjoining the pressing surface severs the tape neatly and precisely.

This invention has been pointed out with particularity in the appended claims. The above and further objects and advantages of this invention will be apparent from the following description taken in connection with the accompanying drawings.

DESCRIPTION OF THE INVENTION

Figure 1:
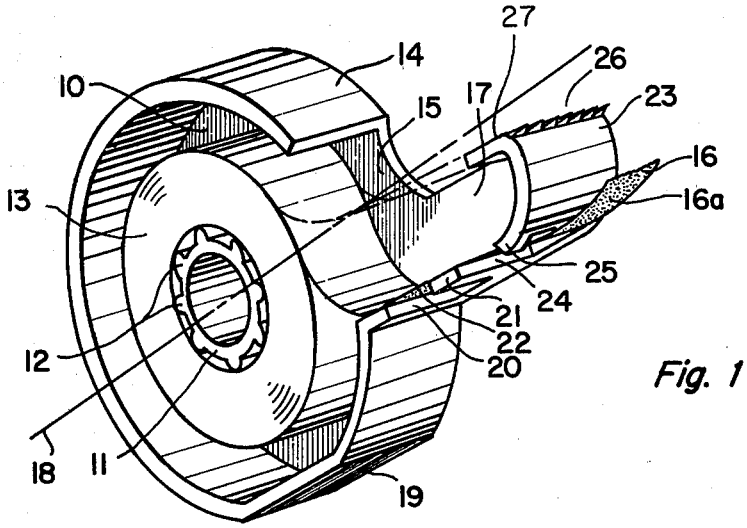
FIG. 1 shows one embodiment of the dispenser/applicator.

FIG. 1 illustrates one embodiment of my invention. This dispenser/applicator is a one-piece device that can be, for example, molded plastic. It includes a supporting, generally circular, planar main frame 10 and a transverse, stationary hub 11 integrally formed with the frame 10. The hub 11 may be an annulus with a smooth outer surface, or, as shown in FIG. 1, with radially extending ribs 12. The hub 11 need only have an outer diameter that will allow a roll 13 of tape to rotate about the hub 11 as tape is drawn from the roll 13. Differently sized frames 10 and hubs 11 can be used depending on the size of the tape roll 13.

Another part of the frame 10 is a shroud 14 that extends transversely from the frame 10, and substantially, but not completely, surrounds the roll 13. The shroud 14 is integral with the frame 10 and extends from the periphery of the frame 10. It strengthens the frame and protects the tape. The shroud 14 is not continuous, but has an opening 15 through which a lead end 16 of the tape passes. The bottom of the shroud 14 includes a flattened base 19 for keeping the dispenser upright when it is not in use.

Also in FIG. 1, a planar arm 17 extends along an axis 18 and is co-planar with the frame 10. The working elements of the dispenser/applicator are included on this arm 17. Integral with and extending transversely from the arm 17 and axis 18 are first and second arms 20 and 21 that form a tape rest. Arm 20 abuts a terminus of the transverse shroud 14 that forms the lower boundary of the opening 15. In molding, the arm 20 and shroud 14 would be formed as integral elements for stiffening. The arm 21 is spaced from the arm 20 along the axis 18. As shown in FIG. 1, the adhesive side 16*a* of the lead end 16 of the tape rests on surfaces of the arms 20 and 21 when the device is not in use. An opening 22 between the arms 20 and 21 minimizes the area of contact of the adhesive side 16*a* and yet provides good finger accessibility to the tape.

A generally U-shaped element 23 is axially displaced from the arm 21. The tape passes from the arm 21 to the outside of the element 23 through an axial space 24. The element 23 extends transversely from the arm 17. The outer, curved surface of the element 23 constitutes a smooth, curved surface that engages the non-adhesive side of the tape and presses it against the object. An axially extending guide 25 from the element 23 is spaced from the arm 17 to loosely capture the tape in a transverse direction and to prevent transverse sliding of the tape thereby to direct the tape to the pressing surface in a positive manner. As the tape passes through the opening 24, the non-adhesive side of the tape is exposed to the curved pressing surface of the element 23 while the adhesive side is exposed for attachment to an object.

Adjoining the pressing surface of the element 23 is a cutting edge 26 that extends transversely to the axis 18 and the arm 17 and that defines the end of the uppermost region of curvature of the element 23. As shown in FIG. 1, the cutting edge can include molded triangular teeth that facilitate cutting the lead end of the tape. In a preferred embodiment, the teeth are beveled in two directions, as shown, to facilitate the dispenser and applicator uses.

Figure 2:
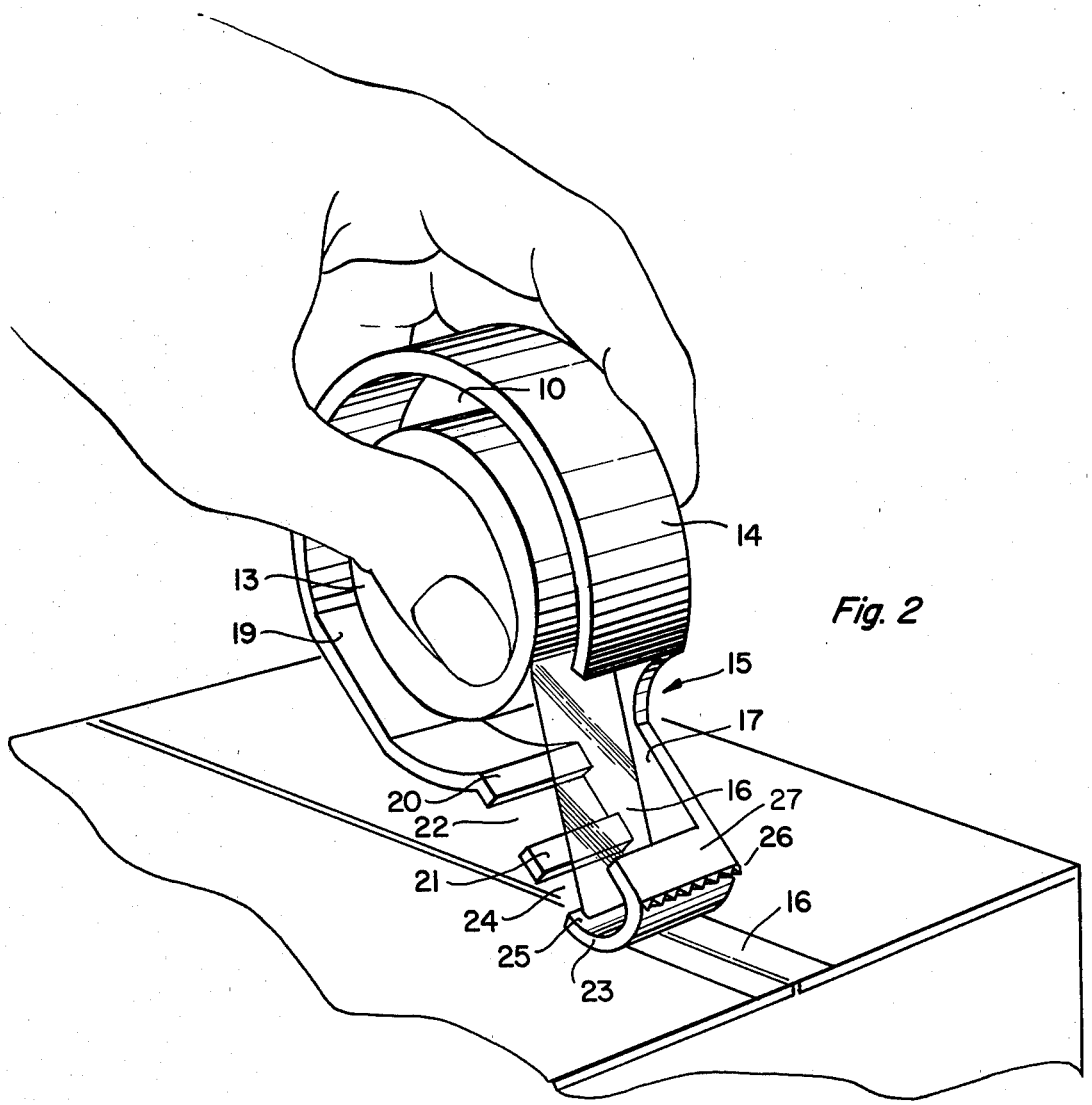
FIG. 2 depicts the dispenser/applicator of FIG. 1 in a position for applying and pressing tape to an object.
Figure 3:
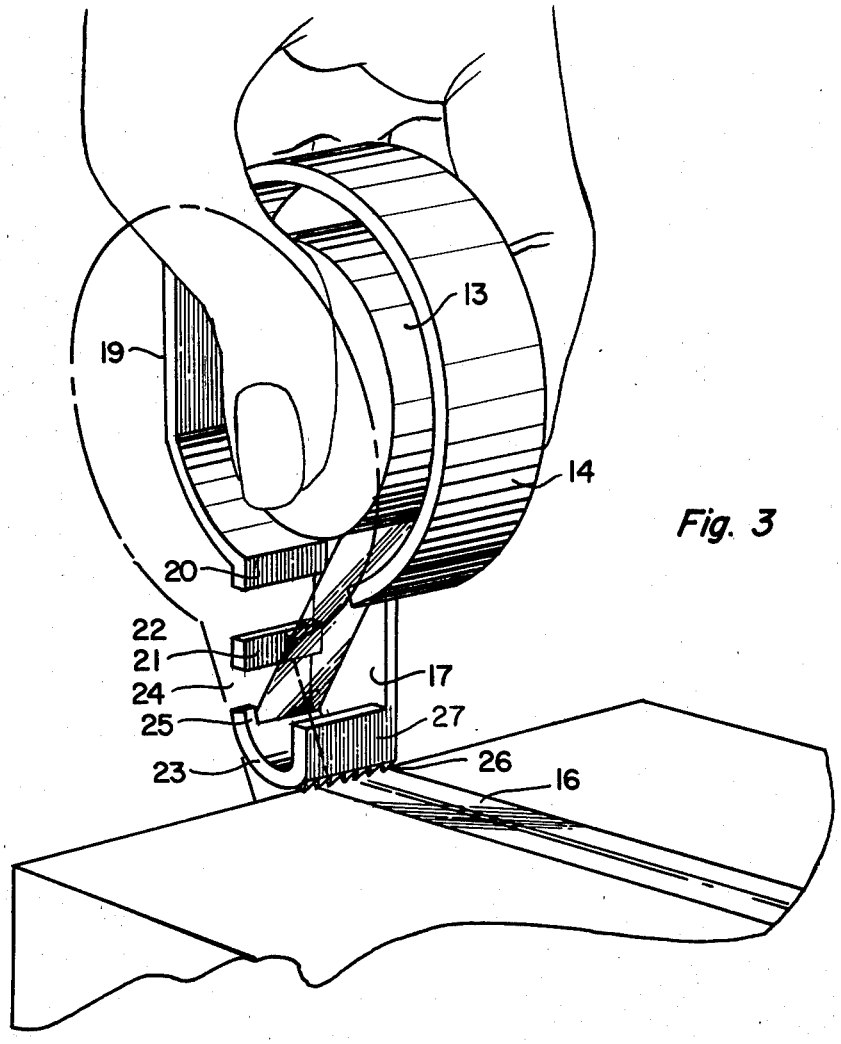
FIG. 3 depicts the dispenser/applicator of FIG. 1 in a position for cutting the tape after it is applied.

FIGS. 2 and 3 show the dispenser/applicator of FIG. 1 in operation. The operator has grasped the supporting frame 10 and the hub 11 in one hand. The adhesive side of the lead end 16 of the tape (shown at rest in FIG. 1) is applied to the object by pressing the tape end 16 to the object with the pressing element 23. The operator continues to exert pressure on the pressing element 23 while drawing the dispenser/applicator over the object. As the operator moves the dispenser/applicator, the tape releases from the tape rest arms 20 and 21 and continues to be pressed against the object. When the exact length of tape has been dispensed and applied, the operator angles the dispenser/applicator so that the cutting edge 26 engages the tape and severs it precisely where desired, as shown in phantom in FIG. 3. The free end of the tape then falls to the tape rest arms 20 and 21, and the tip of the new free end 16 remains adjacent the pressing element 23 ready for the next use. Moreover, the free end 16 of the tape is spaced from the pressing surface 23 but tends to retain the curvature of the pressing surface because the natural curl of the tape is overcome as the tape is applied. Thus, the tape end 16 is readily accessible, but does not tend to curl back on itself.

My device can also be used strictly as a dispenser in either of two ways. The first dispenser use is implemented by grasping the lead end 16 of the tape through the opening 22 shown in FIG. 1. The tape then can be pulled over the pressing element 23 and severed over the cutting edge 26 from below the cutting edge. Alternatively the tape can be drawn directly from the roll 13 through the opening 15 and above the arm 17 directly over the top of a return 27 from the cutting edge 26. This use corresponds to a conventional dispenser and is shown in phantom in FIG. 1.

Figure 4:
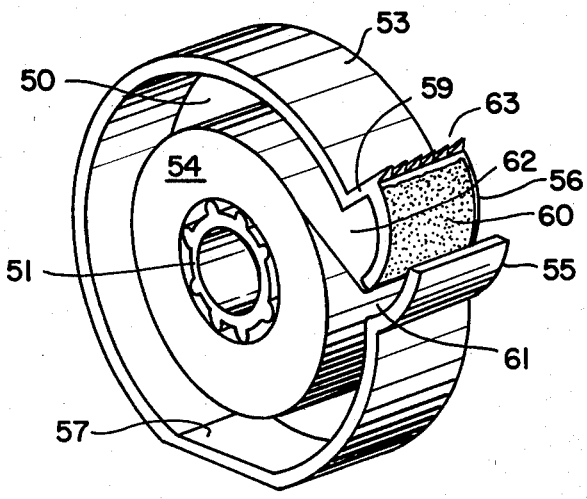
FIG. 4 shows an alternative embodiment of the dispenser/applicator shown in FIG. 1.

An alternative embodiment is shown in FIG. 4. This dispenser/applicator can also be a one-piece, molded plastic unit and includes a supporting planar, generally circular frame 50 and a transverse hub 51 that carries a roll 54 of tape. A shroud 53 extends transversely from the frame 50 and substantially, but not completely, surrounds the roll 54. A flattened base 57 of the shroud serves as a sitting surface and defines the bottom of the device.

A tape rest 55 and a pressing element 56 extend radially from the ends of the shroud 53. The tape rest 55 is a curved surface that is transverse to the frame 50 and forms an extension of the bottom end of the shroud 53. The pressing element 56 includes a radially extending portion 59 that is transverse to the frame 50 and extends from the top end of the shroud 53. Integral with the portion 59 is a curved pressing surface 60 that is spaced from the tape rest 55. Between the tape rest 55 and the pressing surface 60 is an opening 61 through which the lead end 62 of the tape projects. At rest (as shown in FIG. 4), the adhesive side of the tape adheres to the tape rest 55, and the non-adhesive side is exposed to the curved pressing surface 60. The adhesive side of the tip of the lead end is exposed for attachment to an object.

Adjoining the pressing surface 60 and the portion 59 is a cutting edge 63 that extends transversely across the top boundary of the pressing element 60. A guide may also be included on the element 56 to limit lateral movement of the lead end 61 of the tape; such a guide would be analogous to the guide 25 in FIG. 1.

Considering the above description and my object in producing the invention, the advantages of my dispenser/applicator can be seen. The combination of the specific elements in a one piece, hand-held device permits tape to be dispensed in either of two ways and to be applied. By mounting the tape on a hub of a planar frame and including the tape rest, the pressing element, and the cutting edge in the sequence described, the invention can serve as a dispenser. That is, because the tape rest supports the lead end of the tape and the cutting edge severs the tape so that it projects adjacent to the pressing surface, the tape can be grasped at its leading edge and pulled. In this way, the operator can apply the tape as desired. Moreover, the tape can be drawn directly from the roll to the cutting edge so tape is dispensed in a conventional manner. Alternatively, the invention can be used as a dispenser/applicator. Because the tape rest surfaces, pressing surface, and cutting edge are sequentially positioned, an individual can dispense and apply the tape merely by directing the pressing element to the object to be taped. Because the tip of the lead end is adjacent the pressing surface, finger contact with the adhesive side of the tape is minimized. As the tape is initially applied to the object and drawn across it, the action of the pressing element and the guide extending from it assure immediate and accurate contact with the object and eliminate curling and sticking of the tape to itself. The cutting edge adjoins the pressing surface so that the tape can be severed exactly where desired. This further minimizes finger contact with the end of the tape, which is particularly prone to disengagement from the object.

Although specific embodiments of this invention have been disclosed, they are merely representative. To attain the advantages of the invention, its basic principles can be employed by using equivalents of the elements without departing from the invention. Therefore, I intend the following claims to cover all such equivalents and variations that come within the true spirit of my invention.

What I claim as new and desire to secure by Letters Patent of the United States is:

1. A dispenser/aplicator for dispensing and applying tape from a tape roll, the tape having an adhesive side and a non-adhesive side, said dispenser/applicator comprising:

A. an integral planar frame including a main frame means and a contiguous coplanar support means extending from said main frame means and in the plane thereof;

B. hub means transverse to and integral with said main frame means for mounting the tape roll;

C. tape rest means extended normally to and integrally formed with said coplanar support means, said tape rest means consisting of, respectively, first and second spaced, coplanar arms extending from said coplanar support means for contacting, with corresponding surfaces thereof, only the adhesive side of the tape when said dispenser/applicator is not being used;

D. pressing surface means extended normally to and integrally formed with said coplanar support means, said pressing surface means being spaced from said tape rest means for engaging the non-adhesive side of the tape as it is drawn past said arms of said tape rest means thereby to press the adhesive side of the tape against an object;

E. fixed cutting means extended normally to said coplanar support means adjacent said pressing surface for cutting the tape, and F. shroud means about the periphery of said main frame means and extending transversely from said main frame means, said shroud means having a flattened base portion for defining a supporting surface, said tape rest means lying in a plane that is substantially parallel to said supporting surface and spaced therefrom to locate said tape rest means in a plane juxtaposed to said hub means thereby to prevent the end of the tape from reaching the plane of the supporting surface after it is cut, said shroud means having an opening therethrough at said coplanar support means, one termination of said shroud means being formed to engage said tape rest means.

2. A dispenser/applicator as recited in claim 1 wherein said pressing surface means includes means for defining an arcuate pressing surface and means for defining a leading transverse edge that removes tape curl as the tape is drawn from the tape roll past said pressing surface means.

3. A dispenser/applicator as recited in claim 1 or 2 wherein said pressing surface means includes guide means extended toward said tape rest means and spaced from and parallel to said coplanar support means for engaging the edges of the tape thereby to guide the tape to said pressing surface means.

4. A dispenser/applicator as recited in claim 1 or 2 wherein said cutting means comprises a return portion extended toward said main frame means for engaging the adhesive side of the tape when said dispenser/applicator is used as a dispenser.

* * * * *